US005782424A

United States Patent [19]

Horvath et al.

[11] Patent Number: 5,782,424

[45] Date of Patent: Jul. 21, 1998

[54] THREAD BRAKE

[75] Inventors: Attila Horvath, Freudenstadt; Hermann Schmodde, Albstadt; Josef Fecker, Bisingen, all of Germany

[73] Assignee: Memminger-IRO GmbH, Dornstetten, Germany

[21] Appl. No.: 184,400

[22] Filed: Jan. 19, 1994

[30] Foreign Application Priority Data

Jan. 21, 1993 [DE] Germany ..... 43 01 507.7

[51] Int. Cl.[6] ..... B65H 59/22; B65H 51/00; B65H 57/00; D04B 15/44

[52] U.S. Cl. ..... 242/419.3; 66/146; 242/47.01; 242/150 M; 242/157 R; 242/419.4

[58] Field of Search ..... 242/419.3, 419.4, 242/422.2, 150 R, 150 M, 157 R, 47.01; 66/132 T, 132 R, 146; 28/194

[56] References Cited

U.S. PATENT DOCUMENTS

| | | | |
|---|---|---|---|
| 1,908,717 | 5/1933 | Williams | 242/157 R |
| 2,907,535 | 10/1959 | Mindheim et al. | 66/146 |
| 3,409,194 | 11/1968 | Whitehead | 28/194 X |
| 4,809,927 | 3/1989 | Colli et al. | 242/150 R |
| 5,181,666 | 1/1993 | Bitzer | 242/47.01 |
| 5,343,983 | 9/1994 | Horvath et al. | 66/146 X |

FOREIGN PATENT DOCUMENTS

| | | | |
|---|---|---|---|
| 0 234 208 B1 | 12/1989 | European Pat. Off. . | |
| 0 498 464 | 8/1992 | European Pat. Off. . | |
| 0 499 218 | 8/1992 | European Pat. Off. . | |
| 1076736 | 10/1954 | France | 242/150 R |
| 33 18 435 | 11/1984 | Germany . | |
| 27 58 334 | 4/1986 | Germany . | |
| 35 04 739 | 8/1986 | Germany . | |
| 3524151 | 1/1987 | Germany | 66/146 |
| 38 28 762 | 3/1990 | Germany . | |
| 644028 | 8/1962 | Italy | 242/150 R |
| 413601 | 7/1934 | United Kingdom | 242/150 R |
| 545208 | 5/1942 | United Kingdom | 242/150 R |
| 1 449 274 | 9/1976 | United Kingdom . | |
| 2 137 235 | 10/1984 | United Kingdom . | |
| 92/14670 | 9/1992 | WIPO | 242/150 R |

*Primary Examiner*—Michael R. Mansen
*Attorney, Agent, or Firm*—Frishauf, Holtz, Goodman, Langer & Chick, P.C.

[57] ABSTRACT

A plate-type thread brake includes two brake elements pressed resiliently against each other by a load device and receiving the thread passing through between them. These brake elements are eccentrically suspended on bearings on the inside wall of a central opening which only fill out a small part of the opening. Thread guides are also arranged in the region of this central opening.

29 Claims, 11 Drawing Sheets

THREAD BRAKE

BACKGROUND OF THE INVENTION

The invention relates to a thread brake comprising two disc- or plate-shaped brake elements which are resiliently pressed against each other by load means and between which at least one thread to be braked is able to be passed through, at least one of these brake elements having a central opening and being rotatably mounted in the region within its outer contour on bearing means and being adapted to be set in rotary motion in a frictionally engaged manner about an axis of rotation by the thread passing through, and thread guide means for the thread passed between the brake elements.

So-called plate-type thread brakes are widely used on textile machines for braking running threads. These are designed in a conventional manner such that two brake plates are mounted for free rotary motion on a central cylindrical bearing axle and are resiliently pressed against each other by a helical spring placed on the bearing axle. The braking force exerted on the thread passing through between the brake plates which, as a rule, are curved like a torus can be altered by an adjustment nut which is screwed onto a corresponding thread of the bearing axle and allows the pretension of the compression spring to be influenced. Particularly with fast running threads, the basic problem arises with these plate-type thread brakes that the brake plates which often rotate in an uncontrolled manner tend to drive the thread out of its position between the plates, whereupon the brake becomes ineffective. A similar situation can arise when the thread, as sometimes happens during transportation of the thread, becomes jammed on the bobbin or the transportation path before the plate-type thread brake, with the result that for a short time it is subjected to stronger tension due to the effect of the pulling force of the thread supplying device engaging it. When the jamming is suddenly released by this increase in thread tension, a so-called "additional running-off" of the thread occurs. With the known plate-type thread brakes, the additionally running-off thread which thus temporarily becomes slack often places itself in a loop at the side over one of the brake plates. As a result of this, the thread supplying device which keeps on drawing off the thread pulls the thread out of its position between the brake plates so that the thread runs on unbraked alongside the brake plates.

To prevent this unwanted jumping of the thread out of its position between the brake plates, it is known to arrange in the space between the brake plates their own thread guide elements into which the thread can be introduced, for example, via a thread guide slot. Examples of this are given in DE-OS 35 04 739 and DE-OS 33 18 435. However, these thread guide elements lying in the space enclosed by the brake plates and impossible or very hard to reach from the outside cause soiling problems which in practice cannot be overcome and limit the possibilities of use of the entire plate-type thread brake. Such soiling problems also occur with a self-cleaning thread brake known from DE-OS 38 28 762 in the embodiments (FIGS. 22 to 24) in which a drive roll for the brake plates driven by the running thread and simultaneously acting as thread guide element is arranged between the brake plates.

To prevent the running thread from cutting into the brake plates, measures must be taken to ensure that during operation the brake plates execute a rotary motion with respect to the path on which the thread runs. Particularly when the brake plates are driven in a frictionally engaged manner by the running thread, there is the danger that the mounting of the brake plates on the bearing axle will be soiled by deposits of fluff and thread lubricants, which makes the brake plates run sluggishly. Practice shows that the fluff has the tendency to wander between the brake plates and settle there around the bearing axle. It is difficult to locate and eliminate such accumulations of fluff because a build-up of fluff occurring in the space enclosed by the two brake plates is not recognizable from the outside and its removal also involves a high amount of expenditure with mechanical means. If, however, the thread brake is not cleaned in time, this results relatively quickly in damage to the brake plates by the running thread and, consequently, in the entire plate-type thread brake having to be exchanged.

To enforce permanent self-cleaning of the plate-type thread brake, it is also known to drive the brake plates forcibly from an external drive source (DE-OS 27 58 334, EP 0 498 464 A2). However, this requires elaborate gear constructions with high reduction which, for their part, again often give rise to fluff deposits and represent additional sources of disturbance. It is particularly effective, as described in EP 0 499 218 A1, for the disc- or plate-shaped brake elements to be set in oscillatory motions, preferably oriented transversely to the common bearing axis of the brake elements, by an oscillation generating device. However, such an oscillation generating device cannot be provided at all operating locations of a plate-type thread brake, and this applies particularly when it is a question of converting plate-type thread brakes of conventional design on available equipment or machines.

SUMMARY OF THE INVENTION

The object of the invention is, therefore, to create a plate-type thread brake of the kind mentioned at the beginning which with simple, frictionally engaged driving of the brake elements is distinguished by high operational safety and excellent self-cleaning efficiency and offers the possibility of preventing the above-explained undesired jumping-out of the thread with simple means.

To accomplish this object, the thread brake is characterized in accordance with the invention by the at least one brake element being mounted on the bearing means projecting through its central opening and only partially filling out the space enclosed by this opening at a bearing point located eccentrically in relation to the axis of rotation on the inside rim of the opening.

In a preferred embodiment, both brake elements have a central opening, and they are mounted for rotation on the bearing means at a bearing point on the inside rim of the respective opening. Herein the inside rim of the cylindrical opening can lie on a ring made of friction-reducing and/or wear-resistant material. By "ring" in this connection both a separate part of its own inserted in the central opening of the brake elements which, as a rule, is formed of steel or ceramic material and an embodiment are to be understood in which the brake elements are provided at least in the region of the opening rim with a coating of a corresponding material extending around it such that this coating forms the "ring".

As practice has shown, owing to their suspension outside of the center of rotation at the rim of the central opening, fluff does not accummulate between the brake elements and the bearing means. Instead, the fluff is continuously scraped off and prevented from settling. It is expelled via the relatively large central opening which in contrast with the conditions prevailing with a continuous bearing axle is not filled out by the bearing means. While the thread is running, the disc- or plate-shaped brake elements can execute in addition to their rotary motion about their axis of rotation an irregular pendulum motion about an axis extending through their bearing point at the inside rim of the central opening such that the axis of rotation of the brake elements is not spatially fixed but moves with respect to the bearing means. This axis of rotation extends through the center of rotation of the disc- or plate-shaped brake elements which preferably simultaneously forms the center point of the, in particular, cylindrical central opening.

In order to prevent the brake elements from becoming unintentionally released from the bearing means, it is expedient for stop means limiting the axial movability of at least one of the brake elements to be associated with the bearing means. These stop means can comprise at least one stationary stop element arranged in laterally spaced relation to the respective rotatably mounted brake element. In particular, this stop element can be designed so as to project from the outside over the contour of the associated brake element. In a practical embodiment, the stop element can be designed in the form of a bracket with an aperture leaving the central opening of the adjacent brake element at least partly free so that removal of the fluff is not impeded. The bracket can be made of plastic. However, it can also be a bent wire. Furthermore, the stop means can be part of the bearing means, but embodiments are also conceivable in which the stop means comprise stop elements of their own mounted for themselves or are formed by structural parts already provided such as holders and the like or are arranged on such parts.

The thread guide means ensure that the thread to be braked is guided in an orderly manner on the path on which it runs between the brake elements, the path on which the thread runs being selected such that while the thread is running a resulting driving force component occurs in the circumferential direction of the brake elements which ensures safe, frictionally engaged driving of the brake elements by the thread. In principle, it is conceivable to arrange thread guide means outside of the contour of the brake elements and hence reserve the central opening exclusively for the eccentric suspension of the brake elements on the bearing means and the removal of the fluff. However, in a preferred embodiment, thread guide means are arranged in the region of the central opening between the brake elements in order to prevent unwanted jumping of the thread out of its position between the brake plates. Herein the arrangement can be such that the two brake elements are axially centered by the passing thread forcibly guided by the thread guide means.

The thread guide means are arranged within the central opening in offset relation to the axis of rotation of the brake elements and/or to their bearing means. To simplify the construction, they can also be arranged directly on the bearing means themselves, but they are, in any case, separate from the bearing point itself. In contrast with the conditions prevailing with conventional plate-type thread brakes in which the continuous central bearing axle is often simultaneously used as thread guide element with the result that thread abrasion is generated directly at the bearing points of the brake elements and settles there, with the new plate-type thread brake the bearing point for the respective brake element and the thread guide means are spatially separate from one another, also when both means are formed on a common element, for example, a wire bracket. The surface of the thread guide means serving to guide the thread is not in direct contact with the brake elements.

Particularly simple structural conditions are obtained when the bearing means comprise a wire bracket extending through the central opening of the two brake elements, carrying the bearing point and being provided with a thread guide section. For this purpose, the wire bracket can have an essentially U-shaped outward bend with the thread guide section formed on the inside thereof. At the same time, the previously explained stop element delimiting the axial movability of the respective brake element can also be part of this wire bracket forming the bearing means.

Depending on the type and the design as well as the speed of the thread to be braked, alteration of the path on which the thread runs between the brake elements may be desired in order to regulate optimum operating conditions for the thread brake. To make this possible in a simple way, the thread guide means arranged in the central opening of the respective brake element can be adjustable with respect to the axis of rotation of the brake element. In practice, this can, for example, be implemented by the thread guide means having a thread guide element which is mounted for adjustment.

In an expedient embodiment, the bearing means and the thread guide means can have a common shaped part of essentially U-shape, made, for example, of steel or ceramic material, which forms on the inside on a bridge-like part joining two legs a part of the thread guide means, with the shaped part being mounted for adjustment on a stationary holder and for swivel motion on a bearing pin which is axially parallel to the bridge-like part.

In another embodiment, the arrangement may be such that the bearing means and/or the thread guide means each have a pin extending through the central opening, and to facilitate introduction of the thread, the pin of the thread guide means can be provided with a bevelled edge for introduction of the thread at its free end.

Since the new thread brake does not have a continuous, central bearing axle for the brake elements onto which a compression spring is simply pushed, the load means for resiliently pressing the two brake elements onto each other must be constructed so as to take into consideration the structural design of the new thread brake. In principle, the possibility of using spring means designed and arranged in accordance with their purpose as load means for the new thread brake is not excluded, but very simple structural conditions are obtained when the load means are designed so as to act magnetically. For this purpose, they can have at least one permanent magnetic ring connected to a brake element and arranged so as to enclose the central opening. The magnetic load means can be adjustable so as to enable regulation of the pressing force acting between the brake elements in accordance with the respective requirements. For this purpose, at least one permanently magnetic ring can be designed for axial adjustment via a thread with respect to its associated brake element. Load means acting as permanent magnets are known per se in other constructions of plate-type thread brakes (DE-PS 27 58 334, DE-OS 33 18 435, EP 0 499 218 A1).

Since the new plate-type thread brake does not have any parts which increase its space requirement in comparison with conventional plate-type thread brakes, but rather distinguishes itself by a lower space requirement—also requiring no drive devices of its own, etc., it is also exceptionally well suited for the conversion of available equipment or machines operating with known plate-type thread brakes, particularly in textile technology.

BRIEF DESCRIPTION OF THE DRAWINGS

Embodiments of the subject matter of the invention are illustrated in the drawings as follows.

DESCRIPTION OF THE PREFERRED EMBODIMENTS

Figure 1:
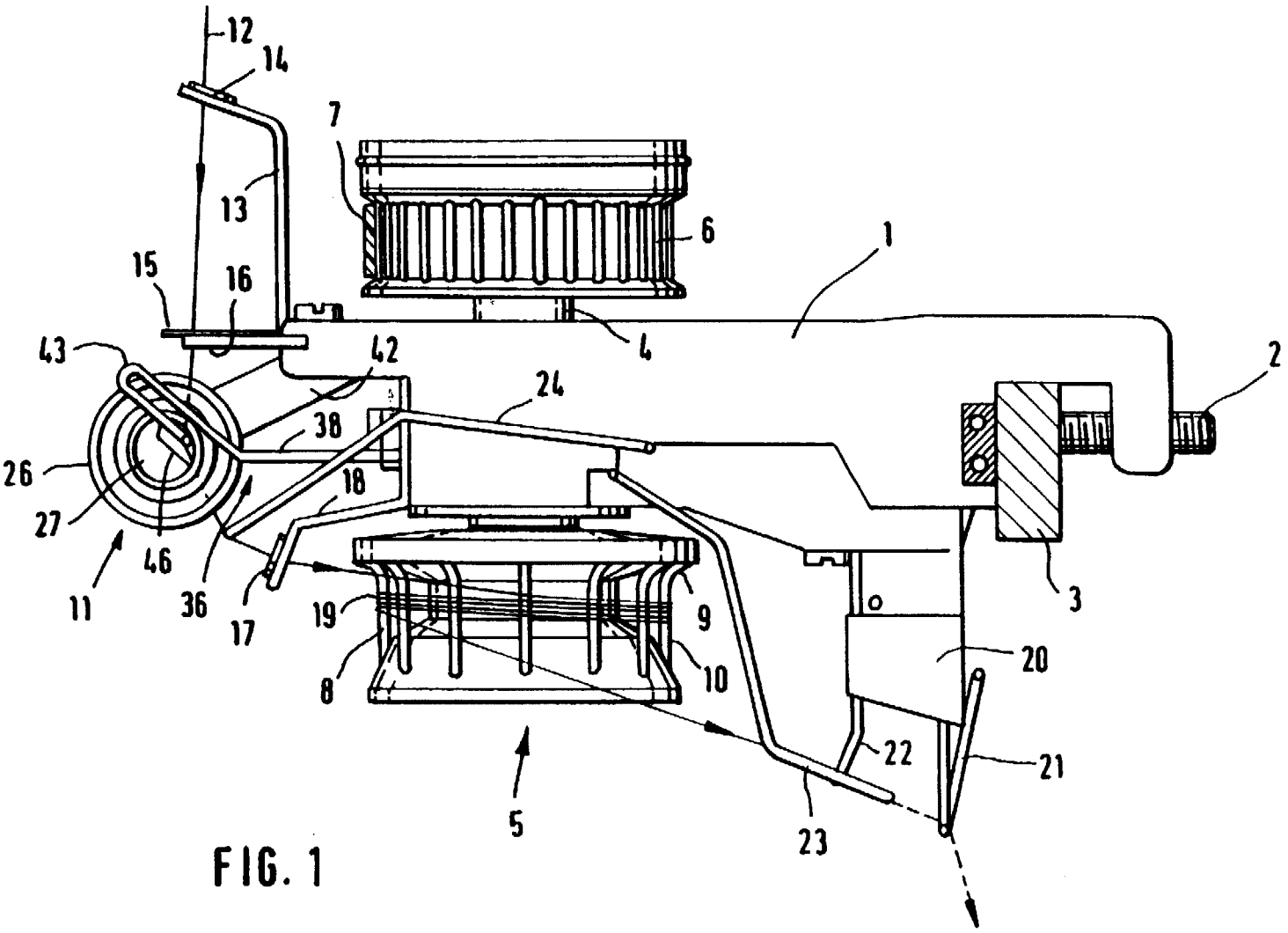
FIG. 1 is a side view of a thread supplying device with a first embodiment of a thread brake according to the invention, in the ready-to-operate state.

The thread supplying device illustrated in FIG. 1, in particular for circular knitting machines, comprises a holder 1 which is designed to be attached by a clamping screw 2 to a carrier ring indicated at 3 of a circular knitting machine. A shaft 4 is mounted for rotation in the holder 1 of casing-like design. On the underside of the holder, the shaft 4 carries a thread supplying element in the form of a so-called winding reel 5 rigidly connected to it and on the top of the holder it is rotationally fixedly connected to a toothed belt pulley 6. The thread supplying devices arranged in a known manner in a ring around the cylinder of the circular knitting machine are driven in synchronization with one another by a toothed belt 7 with which the toothed belt pulley 6 is in engagement.

The winding reel 5 is in the form of a bar cage; details of its design are given in EP 0 234 208 B1. It comprises a number of bars 8 distributed uniformly at equal radial spacings in a ring around its axis of rotation. The bars each have a run-on slant 9 and a straight thread supporting part 10.

A thread brake 11 in the form of a plate-type thread brake is arranged at the front side of the holder 1. The plate-type thread brake is supplied with a thread 12 drawn off a bobbin, not illustrated in detail, via a collar-type eyelet 14 attached by a holding bracket 13 to the holder 1, a knot catcher 15 and a thread delimiting hook 16. The thread 12 running out of the thread brake 11 passes through a thread intake eyelet 17 which is attached via an attachment bracket 18 to the holder 1 and guides the thread 12 in the region of the run-on slant 9 onto the winding reel 5. The thread windings forming continuously on the thread intake side when the winding reel 5 is driven are guided along the run-on slants 9 onto the thread supporting regions 10 of the bars 8 where they are deposited in the form of a thread coil 19 which is taken along in an essentially slip-free manner by the winding reel 5 so that the thread 12 is withdrawn at a constant speed from the bobbin and fed to a thread consumer.

On the way to this thread consumer the thread 12 runs from the thread coil 19 through two thread takeoff hooks 21, 22 which are arranged via a housing 20 on the underside of the holder 1 on the thread takeoff side of the winding reel 5 and between which the thread is felt by a takeoff feeler 23. An intake feeler 24 is provided on the thread intake side between the thread brake 11 and the thread intake eyelet 17. Like the takeoff feeler 23, the intake feeler 24 is mounted for swivel motion on the holder 1 and is connected to switching means, not illustrated in detail, which are accommodated in the holder 1 and trigger a signal for stopping the machine upon swivel motion of the intake feeler 24 or the takeoff feeler 23 occurring as a result of decreasing thread tension.

The thread supplying device described so far is known; it represents a typical example of use of a thread brake 11 which with this thread supplying device serves to uniformly brake the thread 12 coming from the bobbin in order that the thread 12 can be wound up continuously on the winding reel with the necessary winding tension.

Figure 2:
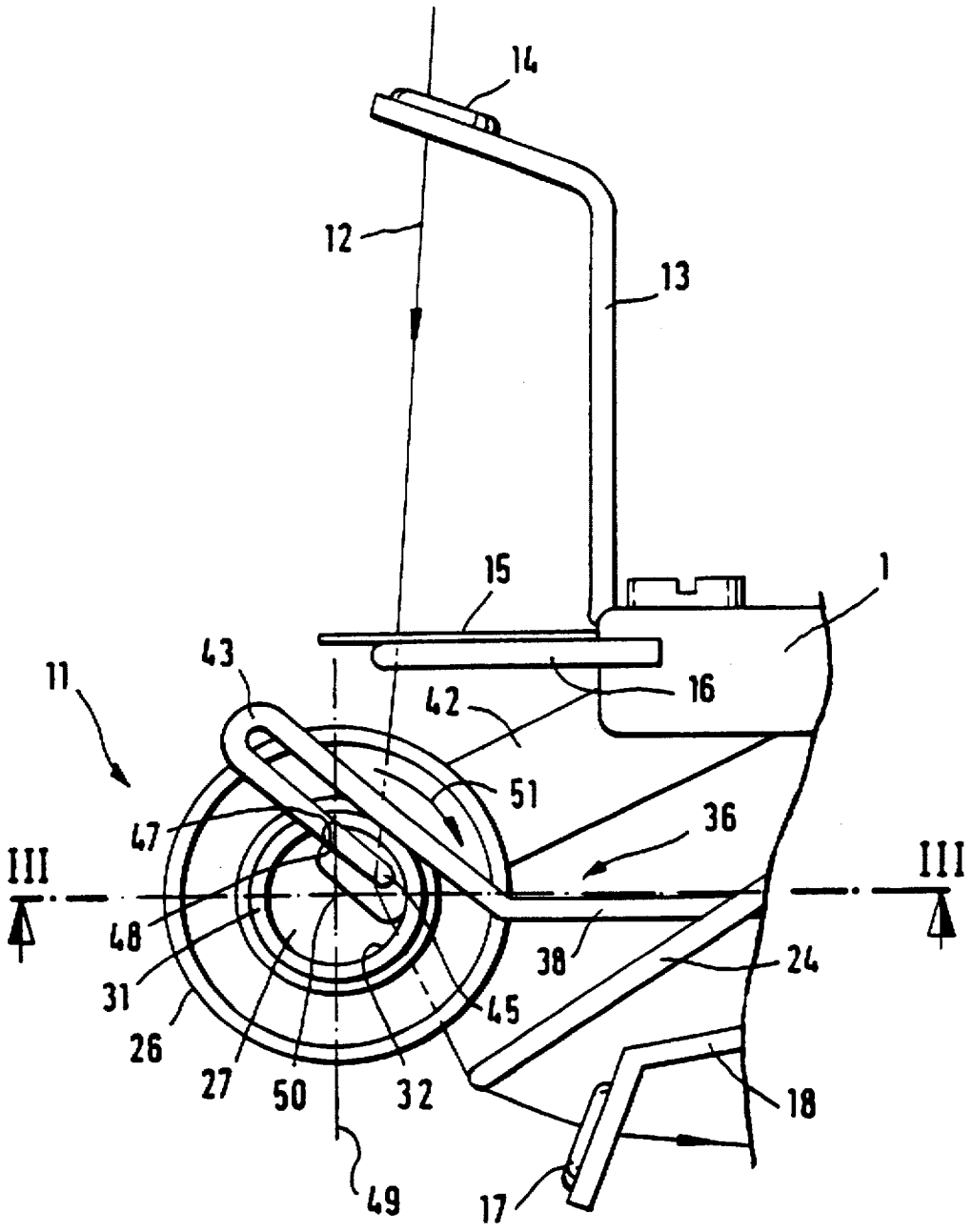
FIG. 2 is a side view of the thread brake of the thread supplying device according to FIG. 1, on a different scale.
Figure 3:
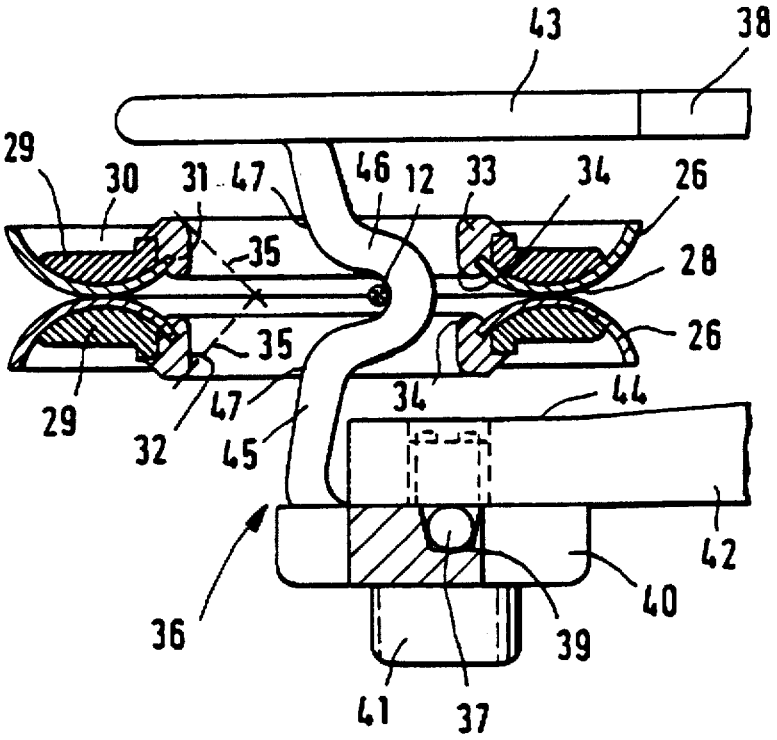
FIG. 3 is a view of the thread supplying device according to FIG. 2, cut along line III—III of FIG. 2, seen in the cutting direction.

The details of the thread brake 11 constructed in accordance with the invention are to be found, in particular, in FIGS. 2 and 3:

The thread brake 11 comprises two round brake elements 26 in the form of two brake discs or brake plates of the same design. Each of the brake elements 26 is of ring-shaped design with a cylindrical, coaxial, continuous opening 27. It is made from steel, plastic or ceramic material and carries a smooth thread brake surface 28 of toroidally dished shape which may also be coated with a wear-resistant material. The two brake elements 26 are resiliently pressed against one another with their convex thread brake surfaces 28 lying on one another in the axial direction by load means. These load means each include a permanently magnetic ring 29 which is inserted in the groove-like recess 30 of the brake element 26 so as to surround the opening 27 and is connected to this brake element 26. A coaxial ring 31 made of a wear-resistant and/or friction-reducing material and connected to the brake element 26 delimits with its essentially cylindrical inside wall 32 the central opening 27. The ring 31 is formed on the brake element 26 and simultaneously also serves to hold the permanent magnetic ring 29.

In the region of its inside wall 32, the ring 31 is chamfered at its end face at 33, 34 so that when the brake elements are pressed axially onto one another in the operating position, the two chamfered parts on the outside form parts of bearing surfaces extending circumferentially in a ring. These are inwardly inclined and point towards each other at a slant, as is to be seen from FIG. 3 and is indicated by two dashed lines 35. The two circular disc- or plate-shaped brake elements 26 are rotatably mounted on bearing means which project through their central opening 27 and are formed by a wire bracket 36 which, as is to be seen from FIG. 2, takes up the central openings 27 only to a small extent in each case so that these essentially remain free.

The wire bracket 36 is received on an essentially right-angled bent end part 37 on one side in a wedge-shaped groove 39 of a holding piece 40 and is rigidly attached via this holding piece 40 by a screw 41 to an extension 42 of the holder 1. On the other side a bracket part 43 bent in an essentially U-shape adjoins a horizontal leg 38. Starting approximately from the circumference of the brake elements 26, the bracket part 43 extends upwards at an incline in laterally spaced relation to the parallel adjacent brake element 26. The bracket part 43 forms together with the extension 42 of the holder 1 which with its inside wall 44 extends in laterally spaced relation to the adjacent brake element 26 (FIG. 3), stop means for the two brake elements 26. The axial movability of the two brake elements 26 is delimited by these stop means such that they are undetachably held on the wire bracket 36 without being impeded in their rotational movability.

The leg of the U-shaped bracket part 43 which is not connected to the straight leg 38 is bent sideways so as to form a bearing part 45 which extends through the two central openings 27 of the brake elements 26 and has an outward bend 46 oriented approximately parallel to the inclined bracket part 43 (FIG. 2).

The sections of the bearing part 45 extending on both sides of the essentially U-shaped outward bend 46 lying approximately half-way between the stop elements in the form of the bracket part 43 and the extension 42 each carry on their upwardly pointing outer side (FIG. 2) a bearing surface 47 curved in an essentially circular shape on which the two brake elements 26 rest with their inside wall 32 likewise forming a bearing surface and with the wedge-shaped chamfered parts 34 of the ring 31.

The two brake elements 26 are thus suspended or supported on the bearing surface 47 of the bearing part 45 at a bearing point 48 (FIG. 2) which lies on the vertical axis 49 through the (imaginary) axis of rotation 50 of the brake elements 26 which coincides with the geometrical center point of the essentially annular disc-like brake elements 26. The bearing point 48 lies on the inside wall 32 of the central opening 27 of the brake elements 26 eccentrically in relation to their axis 50. Spatially it has narrow limitations so that, if required, the brake elements 26 can execute a certain pendulum motion about a bearing axis extending through the bearing point 48 and parallel to the axis of rotation 50.

The U-shaped outward bend 46 forms on its inside thread guide means for the thread 12 which lies within the central opening 27 exactly in the plane of contact between the two thread brake surfaces 28 and which are arranged in radially offset relation to both the axis of rotation 50 and the bearing point 48. The insertion slants resulting from the design of the bearing part 45 and the outward bend 46 facilitate handling of the thread brake during the threading-in so that even a thread which is not properly inserted automatically slips into the outward bend 46 during operation.

Owing to the outward bend 46 acting as thread guide section, the thread 12 passing through is guided laterally in the axial direction so that the two brake elements 26 are forcibly axially centered by the thread 12 running between their two thread brake surfaces 28 and cannot adjust in an uncontrolled manner on the bearing part 45 and come into contact with the stationary parts 43, 44.

The two stop elements in the form of the bracket part 43 and the extension 42 projecting from the outside over the outline of the brake elements 26 merely serve to hold the brake elements 26 undetachably on the wire bracket 36.

When the thread supplying device illustrated in FIG. 1 is in operation, the thread coming in through the collar-type eyelet 14 is deflected slightly to the left at the thread delimiting hook 16. It then runs in between the thread brake surfaces 28 of the brake elements 26 resiliently pressed onto one another and producing the braking force, enters the central opening 27 where it is, in turn, deflected slightly to the right by the U-shaped outward bend 46 forming the thread guide means and after again crossing the thread brake surfaces 28 finally reaches the thread intake eyelet 17. As is to be seen in FIGS. 1 and 2, the outward bend 46 is placed in the central opening 27 such that the thread passes through the clamping points formed by the thread brake surfaces 28 at the side of the vertical axis 49 so that a driving force acting in a frictionally engaged manner in the circumferential direction is exerted by the running thread 12 on the brake elements 26 and sets the two brake elements 26 in rotary motion about their axis of rotation 50 in the direction of the arrow 51 (FIG. 2). Since the two brake elements 26 are only mounted at a bearing point 48 located at a distance above the axis of rotation 50 on the inside circumference of their central opening 27 which is relatively large in comparison with the bearing means, the brake elements 26 can execute the previously mentioned, slight pendulum motion about the bearing point 48, i.e., the axis of rotation 50 is not spatially fixed.

Figure 4:
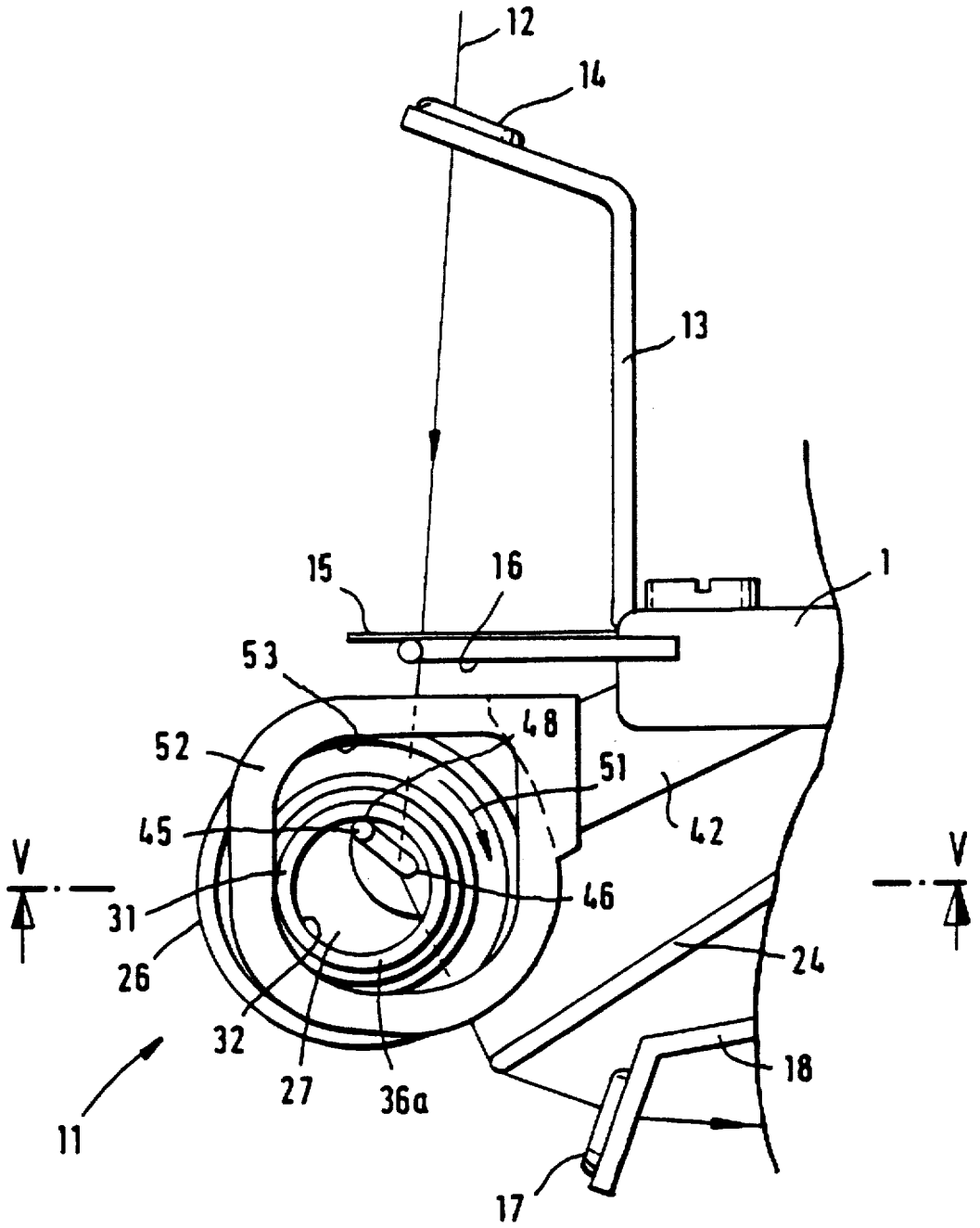
FIG. 4 is a side view of a second embodiment of a thread brake according to the invention, in an illustration corresponding to FIG. 2.
Figure 5:
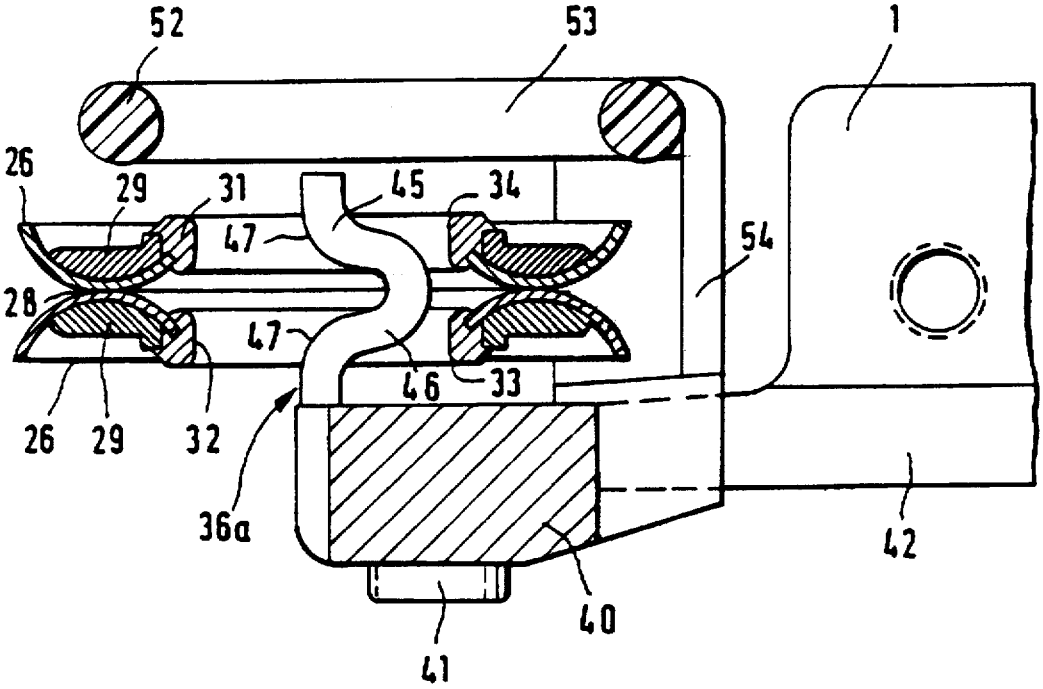
FIG. 5 is a view of the thread brake according to FIG. 4, cut along line V—V of FIG. 4, seen in the cutting direction.
Figure 6:
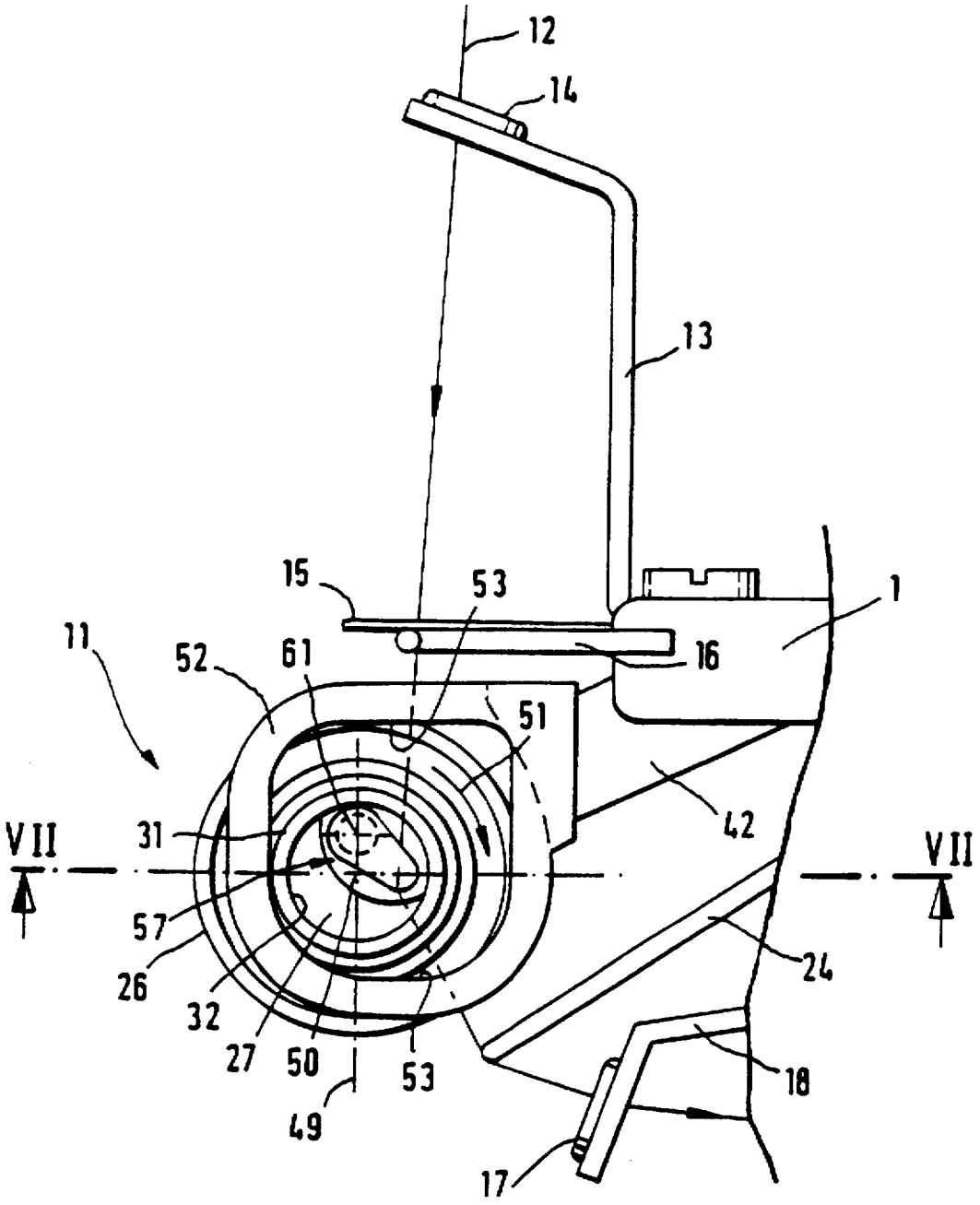
FIG. 6 is a side view of a third embodiment of a thread brake according to the invention, in an illustration corresponding to FIG. 2.

The second embodiment of the thread brake 11 illustrated in FIGS. 4 and 5 corresponds essentially to the first embodiment of the thread brake described with reference to FIGS. 1 to 3. Like parts are, therefore, designated by like reference numerals and are not explained again.

Whereas in the first embodiment the wire bracket 36 directly forms with its bracket part 43 an axial stop element, in the second embodiment the wire bracket **36*a* is essentially reduced to its bearing part 45 crossing the central opening 27 of the two brake elements 26 with the outward bend 46. Instead of the bracket part 43, a bracket 52 which may also be made of plastic is provided as an axial stop element. The bracket 52 has a large continuous opening 53 formed therein and is attached at 54 to the extension 42. The opening 53 extends over the central opening 27 of the two brake elements 26 so that fluff can also not gather on this side when compressed air is blown through the brake elements 26 to clean them from time to time. The elastic bracket 52 also permits easy dismantling of the brake elements 26** and, at the same time, secures them against falling out.

When used for threads 12 of different strength and friction characteristics, it is advantageous to be able to optimally adjust the rotational speed of the brake elements 26 to the respective thread characteristics. This possibility is offered by the third embodiment of the new thread brake 11, as illustrated in FIGS. 6 to 9, in which previously explained elements again are designated by the same reference numerals as in FIGS. 1 to 5 and are not explained again.

Figure 7:
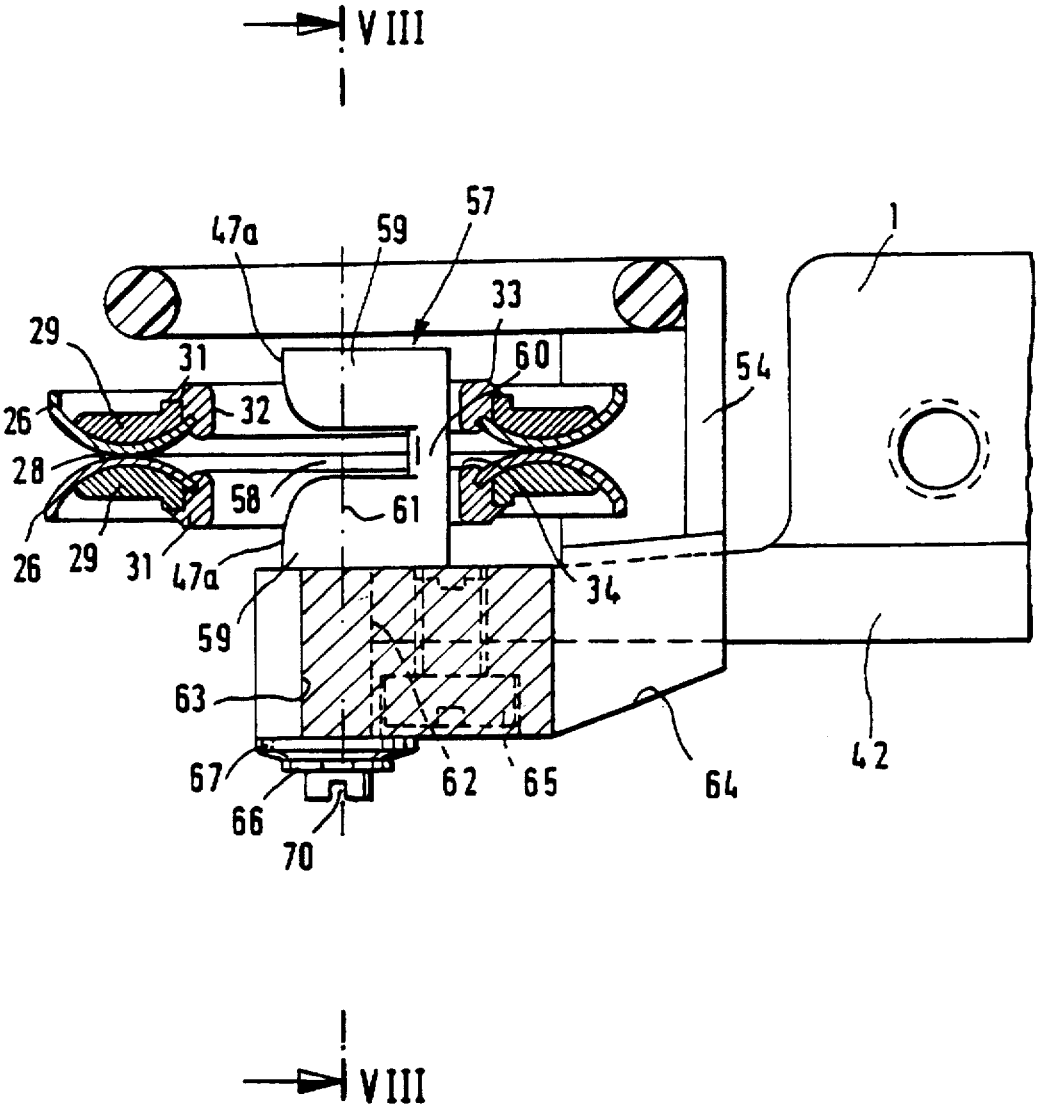
FIG. 7 is a view of the thread brake according to FIG. 6, cut along line VII—VII of FIG. 6, seen in the cutting direction.
Figure 8:
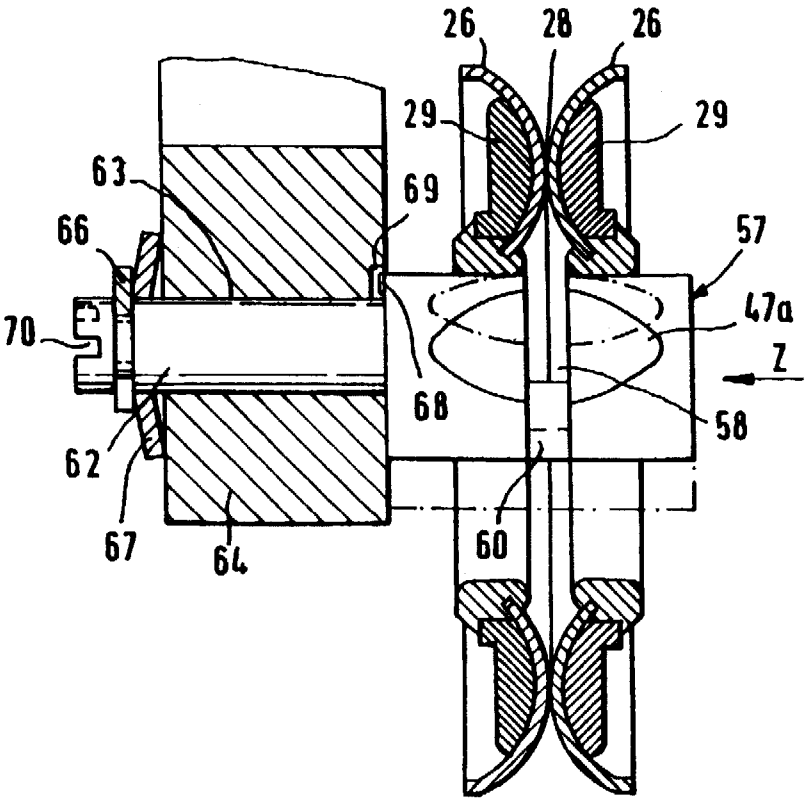
FIG. 8 is a partial view of the thread supplying device according to FIG. 6, cut along line VIII—VIII of FIG. 7, seen in the cutting direction, on a different scale.
Figure 9:
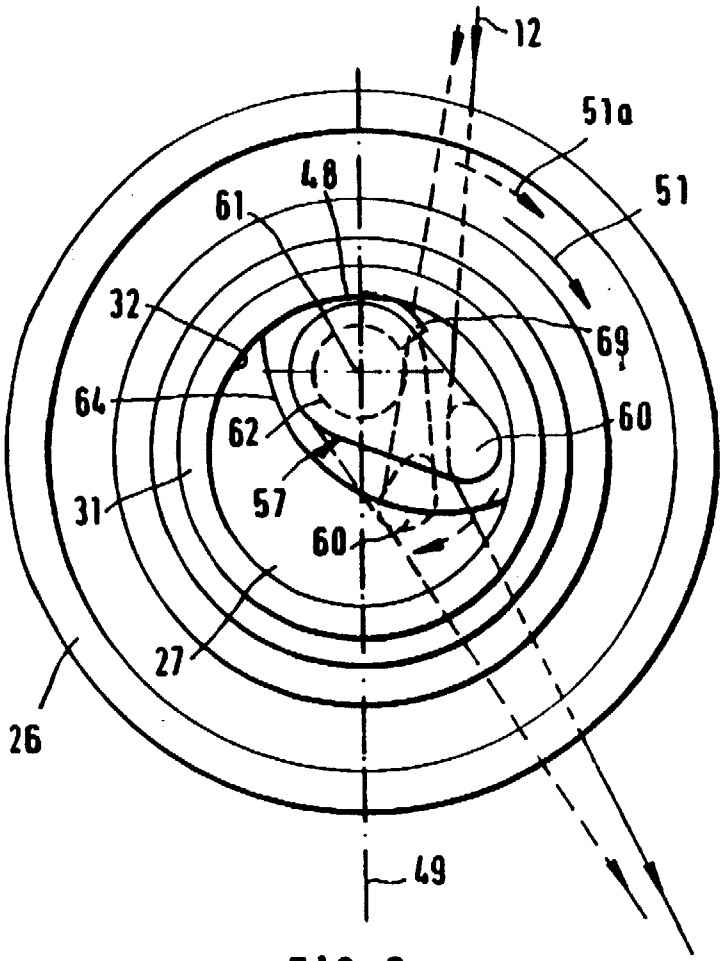
FIG. 9 is a view of the thread brake according to FIG. 8, seen in the direction of arrow Z of FIG. 8.

The regulation of the rotational speed of the brake elements 26 in dependence upon the running speed of the thread is brought about by a corresponding change in the position of the part of the path on which the thread runs between the thread brake surfaces 28 with respect to the vertical axis 49 intersecting the axis of rotation 50. For this purpose, the bearing means for the brake elements 26 and the thread guide means are formed on a bolt-like shaped part 57 which is of approximately wedge-shaped cross-sectional configuration (FIG. 9) and is provided at the center thereof with a thread insertion slot 58 which is formed by two side legs 59 and a bridge-like part 60 joining these, which, in all, produces an essentially U-shaped design. The bridge-like part 60 forms the thread guide means which lie in the central opening 27 of the brake elements 26 in alignment with the plane of contact of the thread brake surfaces 28. The two legs 59 carry the bearing surfaces 47*a* on which the bearing point 48 lies. The bearing surfaces 47*a* extending on both sides of the thread insertion slot 58 are of essentially partially circular-cylindrical design with respect to a swivel axis 61 defined by a cylindrical pin 62 formed on one side and extending in axially spaced relation to the bridge-like part 60. The pin 62 is mounted for rotation in a corresponding bearing bore 63 of a holding piece 64 which is screwed to the extension 42 of the holder 1 at 65 (FIG. 7). The shaped part 57 is clamped against the holding piece 64 by the pin 62, a securing ring 66 and a Belleville spring 67. It carries a detent nose 68 (FIG. 8) which engages a detent groove 69 with corresponding detent recesses on the end face of the holding piece 64 facing it and thus stationarily fixes the shaped part 57 in its respectively adjusted angular position. With the aid of a tool, for example, a screwdriver, which is inserted in an adjustment groove 70 of the pin 62, the shaped part 57 can be raised out of its engagement on the holding piece 64 against the pressure of the Belleville spring 67 and swivelled over its adjustment sector indicated in FIG. 9 along the detent groove 69 into the position indicated in dashed lines in FIGS. 8 and 9 in which the bridge-like part 60 forming the thread guide means lies closer to the vertical axis 49. The torque exerted on the brake elements 26 by the thread 12 passing through is thus reduced so that the rotational speed of the brake elements 26 decreases, as indicated by the dashed shorter arrow 51*a* in FIG. 9.

Figure 10:
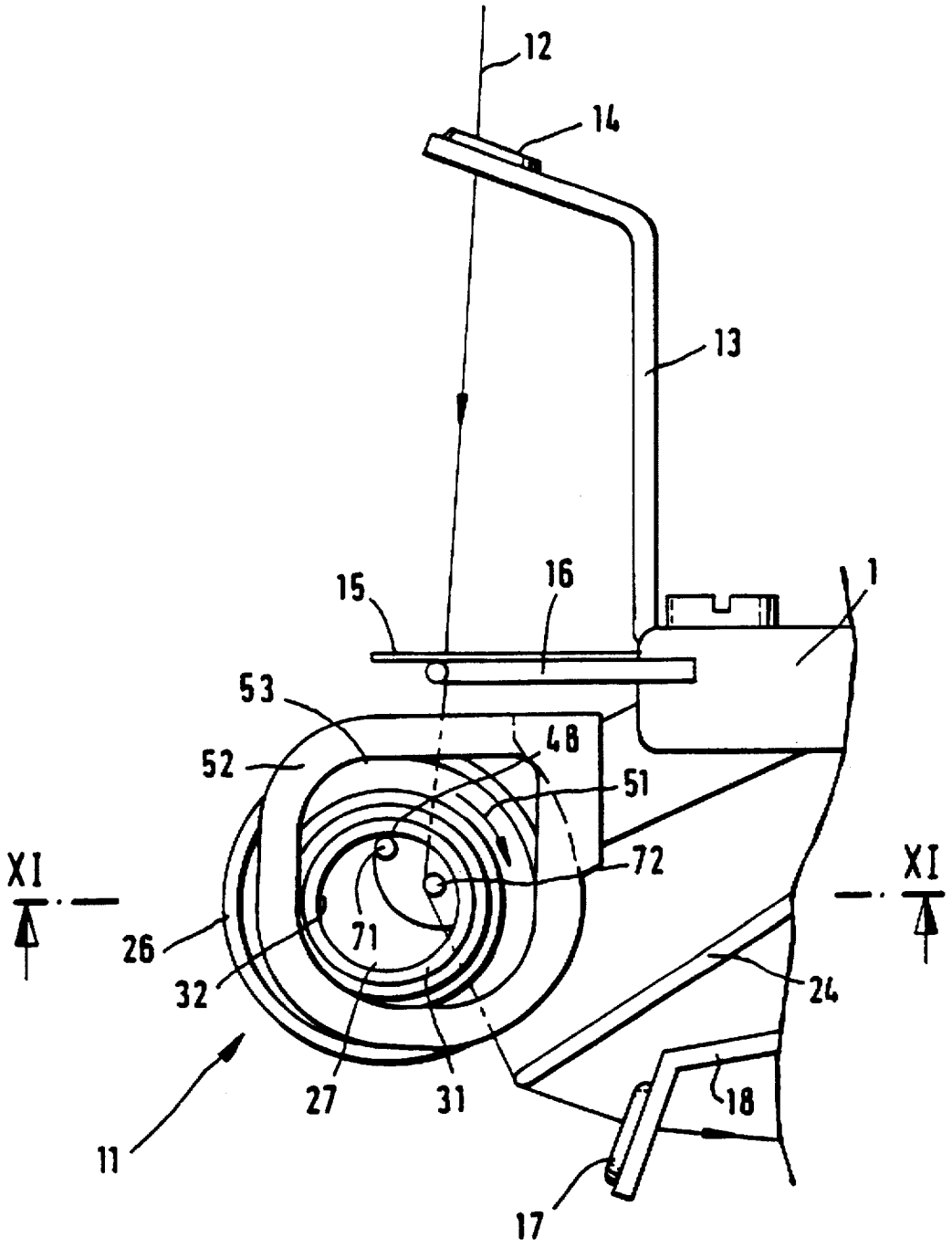
FIG. 10 is a side view of a fourth embodiment of a thread brake according to the invention, in an illustration corresponding to FIG. 2.
Figure 11:
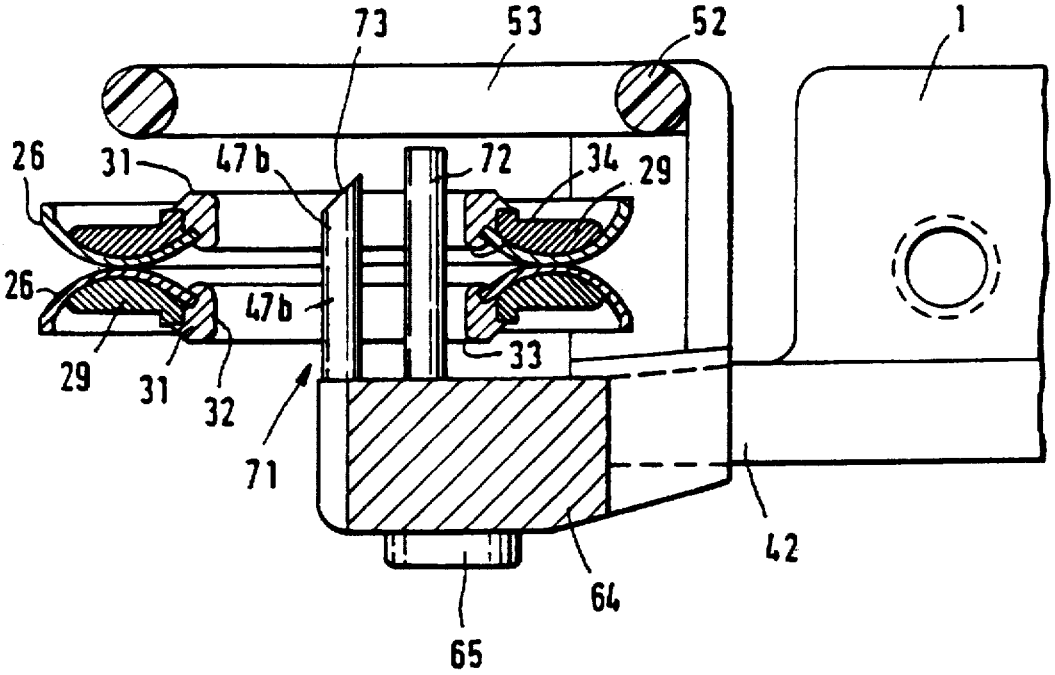
FIG. 11 is a view of the thread brake according to FIG. 10, cut along line XI—XI of FIG. 10, seen in the cutting direction.

A further possibility of designing the bearing means for the brake elements 26 and the thread guide means is illustrated in a fourth embodiment of the new thread brake in FIGS. 10 and 11. Parts identical with those of previously explained embodiments bear the same reference numerals and are not explained again.

In this embodiment, the bearing means and the thread guide means are each designed as smooth cylindrical pins 71, 72 which project axially parallel through the central opening 27 of the brake elements 26 and are anchored at one end in the holding piece 64 which is again screwed to the extension 42 of the holder 1. The shorter, first pin 71 carrying the bearing surface 47*b* is arranged, as is to be seen in FIG. 10, at a distance above the second pin 72 acting as thread guide means. The bearing point 48 is located on its bearing surface 47*b*.

The smooth cylindrical design of the first pin 71 makes collection of fluff and yarn abrasion more difficult and allows the brake elements 26 to adjust to a limited extent on the pin. This adjustment improves the self-cleaning effect of the rotating brake elements 26 in the region of the bearing point 48. The danger of the running thread 12 cutting into the other pin 72 forming the thread guide means is also reduced to a minimum.

To facilitate threading of the thread 12 into the thread brake, the end face of the first pin 71 slants outwards at 73. The thread to be threaded-in is placed between the two brake elements 26 and then moved jointly with these axially in the direction towards the bracket 52 until the two brake elements 26 reach a position in which the thread 12 is introducible via the thread insertion slant 73 illustrated in FIG. 11 into the space between the two pins 71 and 72. The thread tension present while the thread is running centers the two brake elements 26 in the axial direction and holds them in a certain region between the holding piece 64 and the bracket 52.

In the above-described embodiments of the thread brake 11, the braking force is unchangeably predetermined by the design of the permanent magnetic rings 29. To regulate the braking force in dependence upon different threads to be braked, it is possible to exchange the brake elements 26 individually or completely for brake elements 26 with different magnetic characteristics of the permanent magnetic rings 29.

Figure 12:
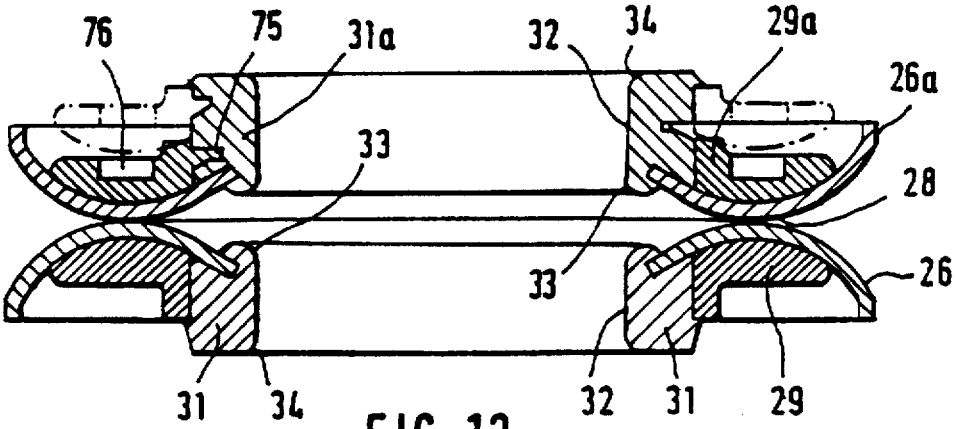
FIG. 12 is a side view of the two brake elements of a thread brake according to the invention with a device for alteration of the pressing force acting between the brake elements, in axial cross-section.
Figure 13:
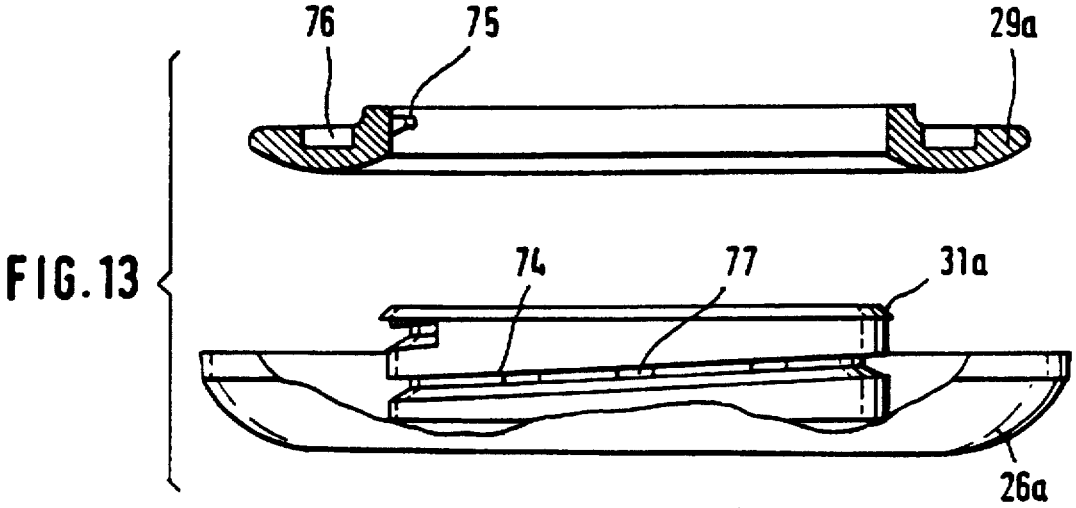
FIG. 13 is a side view of a brake element of the arrangement of FIG. 12 in the dismantled state, partly in axial section.

One possibility of dispensing with this exchange which involves great expenditure owing to both the assembly operation and the necessary storing is shown in the embodiment of the brake elements 26*a* illustrated in FIGS. 12 and 13. These brake elements 26*a* can be exchanged individually or in combination for the brake elements 26 of the above-described embodiments of the thread brake 11.

As is to be seen in FIGS. 12 and 13, in the brake element 26*a* the ring 31*a* is provided with an external thread 74 in which the associated permanent magnetic ring 29*a* is guided with at least one detent nose 75. The permanent magnetic ring 29*a* is provided on the top with recesses 76 for receiving a suitable tool with the aid of which it is possible to turn the permanent magnetic ring 29*a* on the ring 31*a* and thus change its axial spacing from the thread brake surface 28. The most distant position in the axial direction is indicated by dashed lines in FIG. 12.

The forces of attraction acting in the axial direction between the permanent magnetic ring 29*a* and the permanent magnetic ring 29 of opposite polarity of the other brake element 26 depend on the spacing between the two permanently magnetic rings 29, 29*a*, and an approximately square connection exists between the size of the force of attraction and the spacing. Accordingly, the braking force exerted by the thread brake on the thread passing through can be adjusted in accordance with the purpose by simply turning the permanent magnetic ring 29*a*.

Detent recesses 77 (FIG. 13) provided in the turns of the thread 74 for engagement of an extension of the detent nose 75 of the permanent magnetic ring 29*a* therein permit defined positioning of the permanent magnetic ring 29*a* and secure it at the same time against unwanted turning.

The various embodiments of the thread brake 11 were explained in the foregoing with a thread supplying device corresponding to FIG. 1. It will be understood that the thread brake is, of course, employable wherever it is a question of braking a textile or non-textile running thread in a defined manner.

We claim:

1. A thread brake comprising:

two essentially plate-shaped brake elements, at least one of said brake elements being provided with a central opening therethrough and an inside rim at said central opening;

loading means for resiliently pressing said brake elements against each other and for permitting at least one thread passed between said brake elements to be braked;

bearing means for rotatably mounting said at least one brake element in a region within an outer circumference of said at least one brake element;

said at least one brake element being in contact with said thread so as to be set in rotary motion by said thread about an axis of rotation that traverses the central opening of said at least one brake element;

said at least one brake element being suspended from said bearing means which projects through said central opening at a bearing point located eccentrically in relation to said axis of rotation and on the inside rim at said central opening; and said bearing means only partially filling out the central opening in said at least one brake element, thereby allowing fluff scraped off said thread to be expelled through unfilled open space of said central opening.

2. A thread brake as defined in claim 1, wherein both brake elements have a respective said central opening and are rotatably mounted on said bearing means at a respective said bearing point on the inside rim of a respective said central opening.

3. A thread brake as defined in claim 2, further comprising thread guide means positioned in a region of said central opening between said brake elements for guiding a thread.

4. A thread brake as defined in claim 3, wherein both brake elements are axially centered by said thread passing therethrough, with said thread being forcibly guided by said thread guide means.

5. A thread brake as defined in claim 3, wherein said thread guide means is positioned within said central opening in offset relation to said axis of rotation.

6. A thread brake as defined in claim 5, wherein said thread guide means is adjustably arranged in said central opening.

7. A thread brake as defined in claim 6, wherein said thread guide means is adjustable with respect to said axis of rotation.

8. A thread brake as defined in claim 7, wherein said thread guide means is arranged on said bearing means and comprises a thread guide element which is adjustably mounted.

9. A thread brake as defined in claim 6, wherein said bearing means and said thread guide means comprise a common shaped part of essentially U-shape which forms a bridge-like part having two joining legs which form part of said thread guide means, and further comprising a stationary holder for adjustable mounting said shaped part.

10. A thread brake as defined in claim 9, further comprising a swivel pin which mounts said shaped part for swivel motion, said swivel pin being axially parallel to said bridge-like part.

11. A thread brake as defined in claim 3, wherein said thread guide means is positioned within said central opening in offset relation to said bearing means.

12. A thread brake as defined in claim 11, wherein at least one of (a) said bearing means and (b) said thread guide means comprise a pin projecting through said central opening.

13. A thread brake as defined in claim 12, wherein at least said pin of said bearing means has a bevelled edge for introduction of the thread at a free end of said pin.

14. A thread brake as defined in claim 3, wherein said thread guide means is positioned on said bearing means.

15. A thread brake as defined in claim 14, wherein said bearing means comprise a wire bracket extending through said central opening of both of said brake elements, said wire bracket carrying said bearing point and being provided with said thread guide means.

16. A thread brake as defined in claim 15, wherein said wire bracket comprises an essentially U-shaped outward bend with said thread guide means being formed on an inside thereof.

17. A thread brake as defined in claim 16, further comprising stop means for limiting axial movability of at least one of said brake elements and connected with said bearing means, said stop means having at least one stationary stop element arranged in laterally spaced relation to a respective said rotatably mounted brake element, wherein said at least one stop element is part of said wire bracket forming said bearing means.

18. A thread brake as defined in claim 1, wherein said inside rim at said central opening includes a ring made of a material selected from the group consisting of at least one of (a) a friction-reducing material and (b) a wear-resistant material.

19. A thread brake as defined in claim 1, further comprising stop means for limiting axial movability of at least one of said brake elements and connected with said bearing means.

20. A thread brake as defined in claim 19, wherein said stop means have at least one stationary stop element arranged in laterally spaced relation to the respective brake elements.

21. A thread brake as defined in claim 20, wherein each stop element is designed to project from outside over a contour of a respective said brake element.

22. A thread brake as defined in claim 21, wherein each said stop element is in the form of a bracket with an aperture which leaves the central opening of an adjacent said brake element at least partially free.

23. A thread brake as defined in claim 22, wherein said bracket is formed from elastic members.

24. A thread brake as defined in claim 22, wherein said bracket is formed by a bent wire.

25. A thread brake as defined in claim 19, wherein said stop means are integrally formed as part of said bearing means.

26. A thread brake as defined in claim 1, wherein said load means includes at least one magnetic member.

27. A thread brake as defined in claim 26, wherein said load means comprise at least one permanent magnetic ring connected to at least one said brake element and positioned so as to enclose said central opening.

28. A thread brake as defined in claim 27, wherein said magnetic load means are adjustable for alteration of said pressing force acting between said brake elements.

29. A thread brake as defined in claim 28, wherein at least one said permanent magnetic ring is axially adjustable via a thread with respect to an associated said brake element.

* * * * *